US012092394B2

(12) United States Patent
Cao et al.

(10) Patent No.: US 12,092,394 B2
(45) Date of Patent: Sep. 17, 2024

(54) PLATE FIN HEAT EXCHANGER ASSEMBLY

(71) Applicants: L'Air Liquide, Societe Anonyme pour l'Etude et l'Exploitation des Procedes Georges Claude, Paris (FR); Jian-Wei Cao, Zhejiang (CN)

(72) Inventors: Jian-Wei Cao, Hangzhou (CN); Eric Day, Hangzhou (CN); Sophie Lazzarini, Champigny-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 596 days.

(21) Appl. No.: 17/288,228

(22) PCT Filed: Oct. 26, 2018

(86) PCT No.: PCT/CN2018/112184
§ 371 (c)(1),
(2) Date: Apr. 23, 2021

(87) PCT Pub. No.: WO2020/082360
PCT Pub. Date: Apr. 30, 2020

(65) Prior Publication Data
US 2021/0404740 A1 Dec. 30, 2021

(51) Int. Cl.
*F25J 3/04* (2006.01)
*F25J 5/00* (2006.01)

(52) U.S. Cl.
CPC ..... *F25J 3/0423* (2013.01); *F25J 5/002* (2013.01); *F25J 2290/32* (2013.01); *F25J 2290/34* (2013.01)

(58) Field of Classification Search
CPC ..... F25J 5/002; F25J 3/0423; F25J 2290/32; F25J 2290/34; F28D 9/0093; F28D 2021/0033
See application file for complete search history.

(56) References Cited

U.S. PATENT DOCUMENTS 4,239,647 A 12/1980 McNeil
2006/0169000 A1* 8/2006 Judas ..... F25J 3/04787 62/643

(Continued)

FOREIGN PATENT DOCUMENTS

CN 101 103 240 1/2008
CN 104 990 433 10/2015
WO WO 2006/069983 7/2006

OTHER PUBLICATIONS

International Search Report and Written Report for PCT/CN2018/112184, mailed Jul. 29, 2019.

(Continued)

*Primary Examiner* — Frantz F Jules
*Assistant Examiner* — Martha Tadesse
(74) *Attorney, Agent, or Firm* — Justin K. Murray

(57) ABSTRACT

A plate fin heat exchanger assembly (S) for a cryogenic air separation unit, comprising: a heat exchanger having at least two cryogenic liquid inlets (B,C) at least two cryogenic liquid outlets (B,C), at least one nitrogen-rich stream inlet (D) at a first end of the heat exchanger and at least one nitrogen-rich stream outlet at a second end of the heat exchanger, the heat exchanger configured to receive a flow of at least one nitrogen-rich stream (WN,LPGAN) of the air separation unit at the at least one nitrogen-rich stream inlet and separate flows of at least two cryogenic liquids (LOX, LIN,LR) at the at least two cryogenic liquid inlets; wherein the inlet of the first of the cryogenic liquids is closer to the first end than the outlet of the second of the cryogenic liquids.

11 Claims, 4 Drawing Sheets

(56) References Cited

U.S. PATENT DOCUMENTS

| | | | | |
|---|---|---|---|---|
| 2012/0227442 | A1 | 9/2012 | Russ et al. | |
| 2013/0086941 | A1* | 4/2013 | Howard | F25J 3/0423 62/643 |
| 2015/0323247 | A1* | 11/2015 | Shelat | F28D 9/0093 165/140 |
| 2022/0074656 | A1* | 3/2022 | Davidian | F25J 3/04309 |
| 2023/0221068 | A1* | 7/2023 | Davidian | F25J 3/0423 62/643 |

OTHER PUBLICATIONS (Edited by) Hands, B.A., "Cryogenic Engineering," Academic Press, 1986, pp. 213 and 215-216.

* cited by examiner

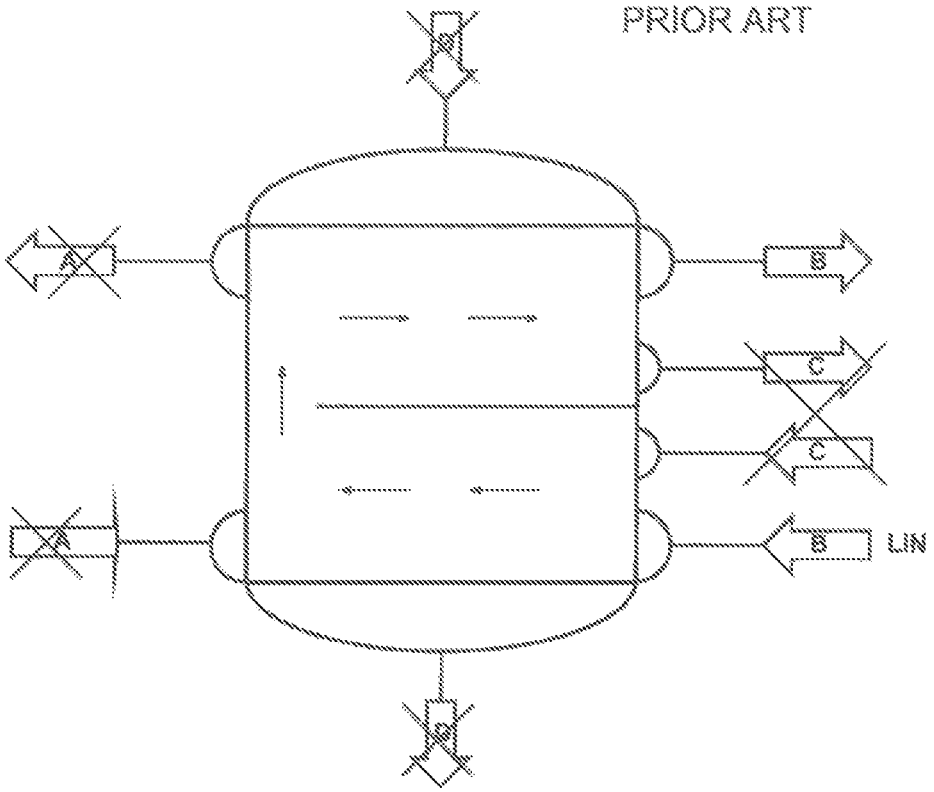
FIG. 1C
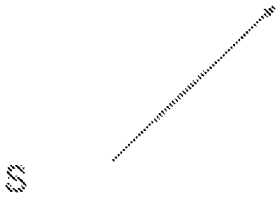

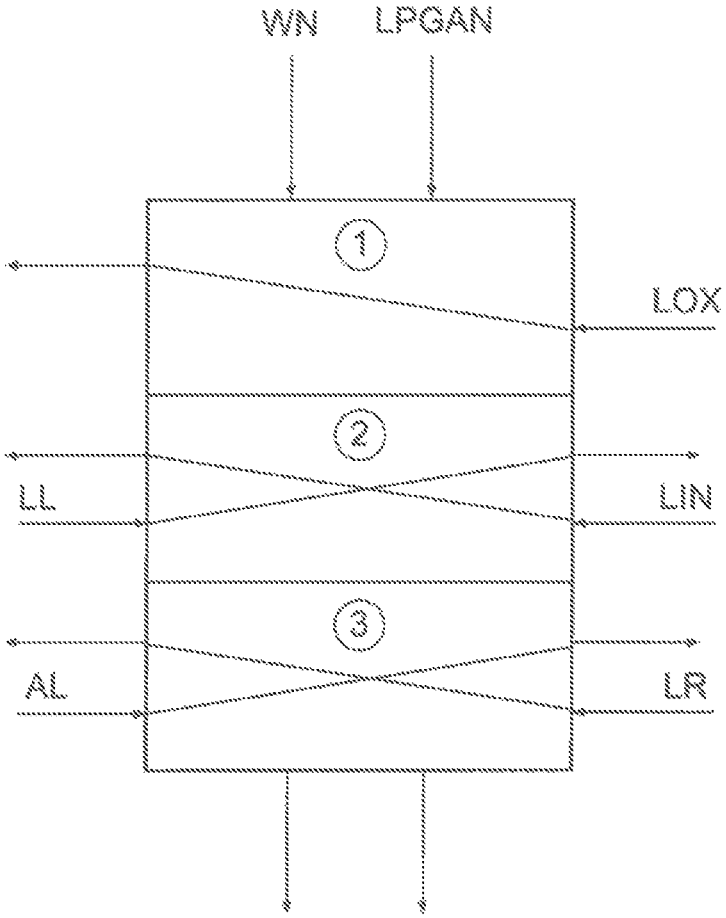
FIG. 3
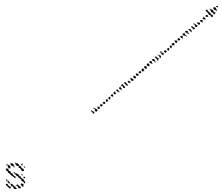

PLATE FIN HEAT EXCHANGER ASSEMBLY

The present invention relates to a plate fin heat exchanger assembly and a system for use in a cryogenic air separation plant. The invention permits simplification of the design of a cross-flow subcooler for an air separation unit while maintaining global performance.

A cryogenic air separation unit includes a main heat exchanger for cooling feed air against return streams from a column system used to separate the air from the heat exchanger. The column system contains at least one column in which the air is separated at a cryogenic temperature by distillation.

The column system may comprise a single column only but frequently included a higher pressure distillation column and a lower pressure distillation column. Liquid streams such a bottom liquid richer in oxygen that the feed air and a sidestream liquid richer in nitrogen that the feed air are expanded in valves and sent from the higher pressure column to the lower pressure column or another part of the column system, for example the top condenser of an argon column.

In one example of a typical air separation unit, saturated bottom liquid and nitrogen enriched liquid(s) from the higher pressure distillation column are sub-cooled in a heat exchanger against a nitrogen stream from the lower pressure distillation column (lower pressure column) before the sub-cooled streams are sent to the lower pressure distillation column. Sub-cooling the bottom liquid and nitrogen enriched liquid stream(s) prior to introduction into to the lower pressure distillation column tends to minimize flashing of such liquid streams in the column, thereby maximizing liquid reflux in the lower pressure column which enhances the recovery of oxygen product and argon product.

In addition, sub-cooling of the bottom liquid and nitrogen enriched liquid streams aids in the recovery of refrigeration from the nitrogen streams, namely the nitrogen product stream and/or the waste nitrogen reducing the external refrigeration requirements for the air separation plant.

Sub-cooling the bottom liquid and nitrogen enriched liquid streams is preferably targeted at temperatures very close to the temperatures of nitrogen product stream and/or the waste nitrogen stream in order to recover most of the refrigeration and maximize refrigeration recovery from the nitrogen streams.

The liquid oxygen product is frequently subcooled in the heat exchanger before being sent to a storage tank.

Typical liquid subcoolers are described in "Cryogenic Engineering", ed B. A. Hands, Academic Press, 1986, pp. 213 and 215-216.

Usually, the exchange of heat between the nitrogen streams from the lower pressure column and the kettle liquid and shelf liquid streams from the higher pressure column is carried out using a Brazed Aluminum Heat Exchanger (BAHX), commonly referred to as a sub-cooler. This sub-cooler could be a separate, stand-alone heat exchanger or may be packaged within the primary heat exchanger shell and integrated therewith.

A sub-cooler typically would involve high capital costs as well as packaging challenges and may also result in high pressure drops of the cooling nitrogen streams. It is desirable to provide offers with more design flexibility in terms of selection of the quantity, dimensions, and number of layers, and flow direction for each stream traversing through the sub-cooler.

Classical cross-flow subcooler design orients the warm liquid streams according to temperature level with the streams requiring the coldest outlet temperature exiting the exchanger at the cold end. For example, in an air separation process using a double column with a lower pressure column whose base is thermally linked to the top of a higher pressure column, the designer may send two side streams from the higher pressure column to the lower pressure column: a liquid nitrogen stream and a lean liquid stream, richer in oxygen and poorer in nitrogen than the liquid nitrogen stream.

Lean liquid and liquid nitrogen are cooled first against waste nitrogen gas and low pressure nitrogen gas, containing more nitrogen than the waste nitrogen gas, both of which come from the low pressure column. This partially warms the gaseous nitrogen streams before they are used to cool the warmer fluids, such as the feed air in the main heat exchanger.

Liquid oxygen enters the subcooling exchanger at a temperature colder than the lean liquid and liquid nitrogen but exits at a temperature warmer than the outlet temperature of lean liquid and liquid nitrogen. This creates the need for different passage widths for different warm fluids at the same point in the exchanger.

Simulation of such a design with different passage widths at the same point in the exchanger is complex. When the liquid oxygen flow rate passing through the subcooler is very small compared to the other flow rates, an approximation can be made with negligible impact to the performance of the exchanger. However, the larger the liquid oxygen flow rate, such as that for a process producing large amounts of liquid oxygen product or a pumping process with liquid oxygen passing through the storage tank before being vaporized in the main exchanger, the more accurate the calculation required.

FIGS. 1A, 1B and 1C show cross-sections of the sections of a classical plate fin heat exchanger used as a subcooler with an arrangement devoted to cooling the liquid streams. Each of the figures shows the arrangements for the layer devoted to a single cooling layer, each layer for a stream to be cooled being separated from the next later for a stream to be cooled by a layer for a stream to be warmed.

In this way heat is transferred from one layer to another. The stream D enters the top of the subcooler (crossed out arrow D) through an inlet, flows straight down through the subcooler and emerges in a warmed state from the warm end of the subcooler via an exit. Stream D is the cold stream, waste nitrogen, to which heat is transferred and comes from the low pressure column of an air separation unit. Streams A and B are liquid nitrogen and lean liquid from the higher pressure column, and stream C is liquid oxygen from the bottom of a low pressure column. Liquid oxygen C enters the subcooling exchanger at a temperature colder than the inlet temperature of lean liquid and exits the exchanger at a temperature warmer than the outlet temperature of lean liquid.

FIG. 1A shows stream with its inlet and outlet at a central region of the subcooler, so that the liquid oxygen is not removed at a temperature close to that of the cold end of the subcooler, unlike liquids B and A.

The liquid C crosses the subcooler in a direction orthogonal to the direction of flow of gas D, then reverses direction to return in the opposite direction, both inlet and outlet being at the same side of the subcooler.

Liquids A and B each have their respective inlet and outlet at opposite sides of the subcooler.

Figure 1A:
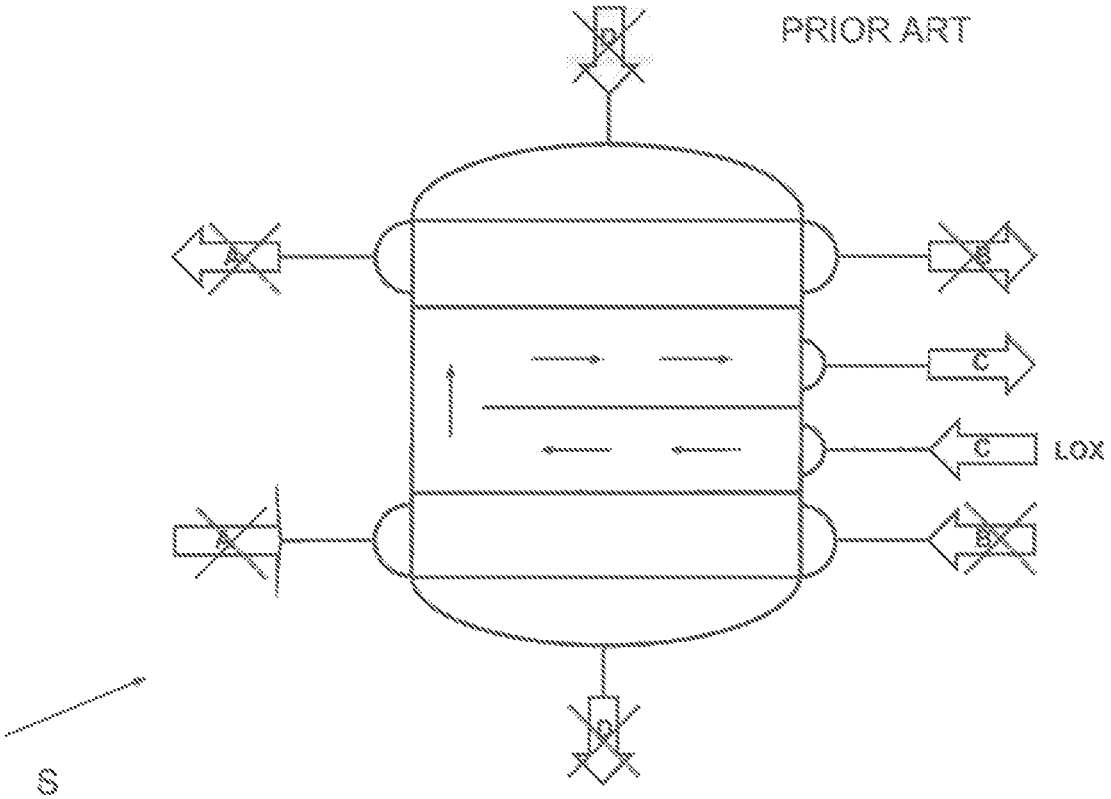
FIG. 1B shows liquid A which has an inlet at the warm end of the subcooler and an outlet at the cold end of the subcooler. The liquid A crosses the subcooler in a direction orthogonal to the direction of flow of gas D, then reverses direction to return in the opposite direction, both inlet and outlet being at the same side of the subcooler.
FIG. 1C shows liquid B which has an inlet at the warm end of the subcooler and an outlet at the cold end of the subcooler. The liquid B crosses the subcooler in a direction orthogonal to the direction of flow of gas D, then reverses direction to return in the opposite direction, both inlet and outlet being at the same side of the subcooler.
Figure 1B:
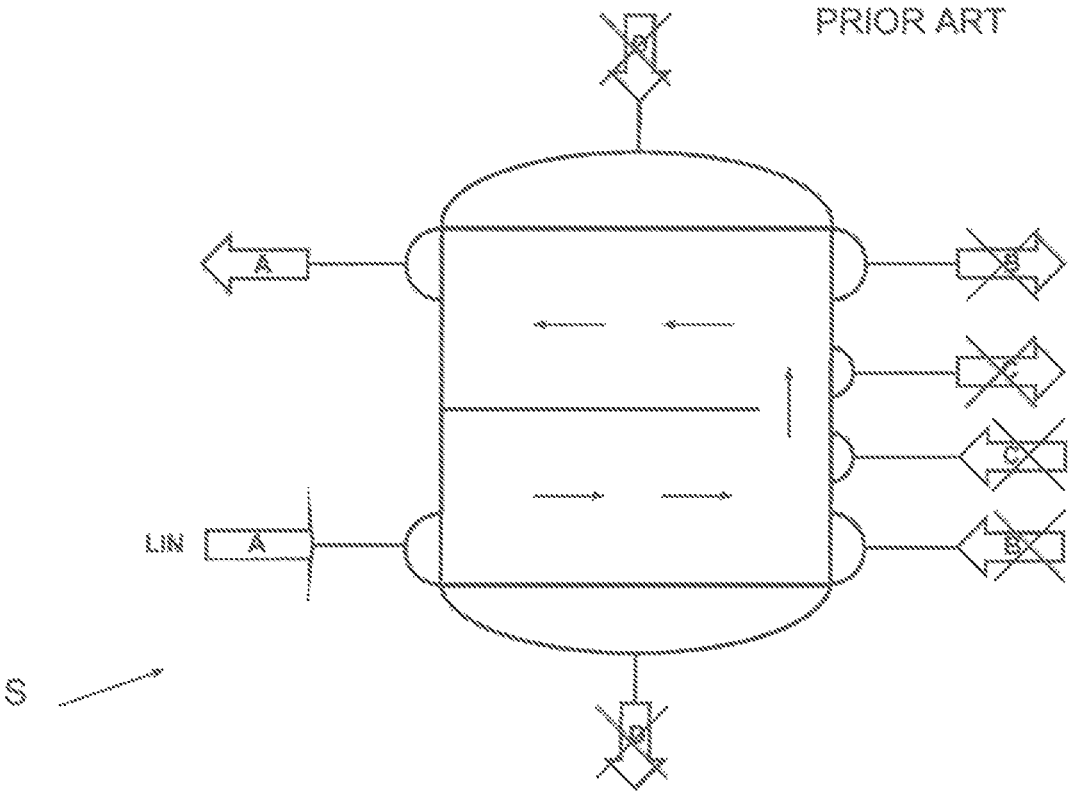

FIGS. 1B and 1C show a subcooler with liquid flowing in a cross counterflow arrangement where the liquid stream passes across the bottom of the heat exchanger, is turned around and then passes back across the upper part of the exchanger.

What is needed therefore is an improved sub-cooler heat transfer assembly and an improved heat transfer system for a cryogenic air separation plant that mitigates the above-identified problems.

Classical subcooler design involves cools the warm fluids requiring the coldest outlet temperatures in the coldest part of the exchanger. The main idea of the invention is to cool the liquid oxygen in the coldest part of the exchanger rather than the lean liquid and liquid nitrogen. This eliminates the need for multiple passage widths at the same temperature level in the exchanger, facilitating in-house design.

The LOX could also be cooled in a second subcooler arranged in parallel, in a process similar to that of US20060169000 but it would require an additional core and controlling the gaseous nitrogen flow rates to each core.

According to the invention, there is provided a plate fin heat exchanger assembly for a cryogenic air separation unit, comprising: a heat exchanger having at least two cryogenic liquid inlets, at least two cryogenic liquid outlets, at least one nitrogen-rich stream inlet at a first end of the heat exchanger and at least one nitrogen-rich stream outlet at a second end of the heat exchanger, the heat exchanger configured to receive a flow of at least one nitrogen-rich stream of the air separation unit at the at least one nitrogen-rich stream inlet and separate flows of at least two cryogenic liquids at the at least two cryogenic liquid inlets; the heat exchanger configured for receiving a first flow of at least one cryogenic liquid of an air separation unit and for channeling the first flow of the at least one cryogenic liquid in a cross flow orientation from a first of the cryogenic liquid inlets to a first of the cryogenic liquid outlets; the heat exchanger being configured for receiving a second flow of at least one cryogenic liquid of an air separation unit and for channeling the second flow of the at least one cryogenic liquid from a second of the cryogenic liquid inlets to a second of the cryogenic liquid outlets; the heat exchanger further configured for receiving a portion of the flow of the at least one nitrogen-rich stream and for channeling a portion of the flow of the at least one nitrogen-rich stream in a first direction within the first heat exchange segment from the at least one nitrogen-rich stream inlet to the at least one nitrogen-rich stream outlet to sub-cool both the first flow of the at least one cryogenic liquid and the second flow of the at least one cryogenic liquid and wherein the first direction is generally orthogonal to the first flow of the at least one cryogenic liquid and preferably to the second flow of the at least one cryogenic liquid wherein the inlet of the first of the cryogenic liquids is closer to the first end than the outlet of the second of the cryogenic liquids.

Other optional features of the invention include:

- the outlet and/or inlet of the first of the cryogenic liquids is closer to the first end than any cryogenic liquid inlet and/or cryogenic liquid outlet of the heat exchanger.
- the first flow of at least one cryogenic liquid comprises a flow of liquid oxygen from the lower pressure column.
- the second flow of at least one cryogenic liquid comprises a flow of bottom liquid from the higher pressure column or a flow of nitrogen enriched liquid from the higher pressure column or a flow of liquefied air or a flow of liquefied nitrogen.
- the assembly comprises a third cryogenic liquid inlet, a third cryogenic outlet, the first heat exchanger being configured for receiving a third flow of at least one cryogenic liquid of an air separation unit and for channeling the third flow of the at least one cryogenic liquid from a third of the cryogenic liquid inlets to a third of the cryogenic liquid outlets wherein the inlet of the first of the cryogenic liquids is closer to the first end than the outlet of the third of the cryogenic liquids.
- the second or third cryogenic liquid inlet is closer to the second end than any other cryogenic liquid inlet or outlet.
- the flow of at least one nitrogen-rich stream in the first direction is a flow in an upward orientation.
- the flow of at least one nitrogen-rich stream in the first direction is a flow in a downward orientation.
- the cryogenic liquid inlets are disposed vertically below the corresponding cryogenic liquid outlets such that the overall flow of the cryogenic liquids is in an upward flow orientation if the at least nitrogen-rich stream is a flow in a downward orientation.
- the cryogenic liquid inlets are vertically above the corresponding liquid outlets if the nitrogen-rich stream flow is in an upward direction.

According to another aspect of the invention, there is provided a process for cooling and warming streams from a cryogenic air separation unit in a heat exchanger according to any preceding claim wherein at least one nitrogen-rich stream selected from the group comprising a waste nitrogen stream, a product nitrogen stream, or other nitrogen-rich return stream from the column system is warmed by passing through the heat exchanger from the nitrogen enriched fluid inlet to the nitrogen enriched fluid outlet, a liquid oxygen stream is cooled by passing from the first cryogenic liquid inlet to the first cryogenic liquid outlet and another cryogenic stream is cooled by passing from the second cryogenic liquid inlet to the second cryogenic liquid outlet, such that the liquid oxygen stream is cooled exclusively in the region of the heat exchanger proximate to the first end.

The liquid oxygen stream may be cooled to a temperature at most 15° C., preferably at most 10° C., above the temperature at which the at least one nitrogen rich stream enters the nitrogen-rich stream inlet.

The invention will now be described in greater detail with reference to FIGS. 2 and 3 which represent cross-sections of the plate fin heat exchanger used as a subcooler.

FIG. 2 is to be compared with FIG. 1 showing the same fluids but with the flow arrangement of the present invention.

Figure 2A:
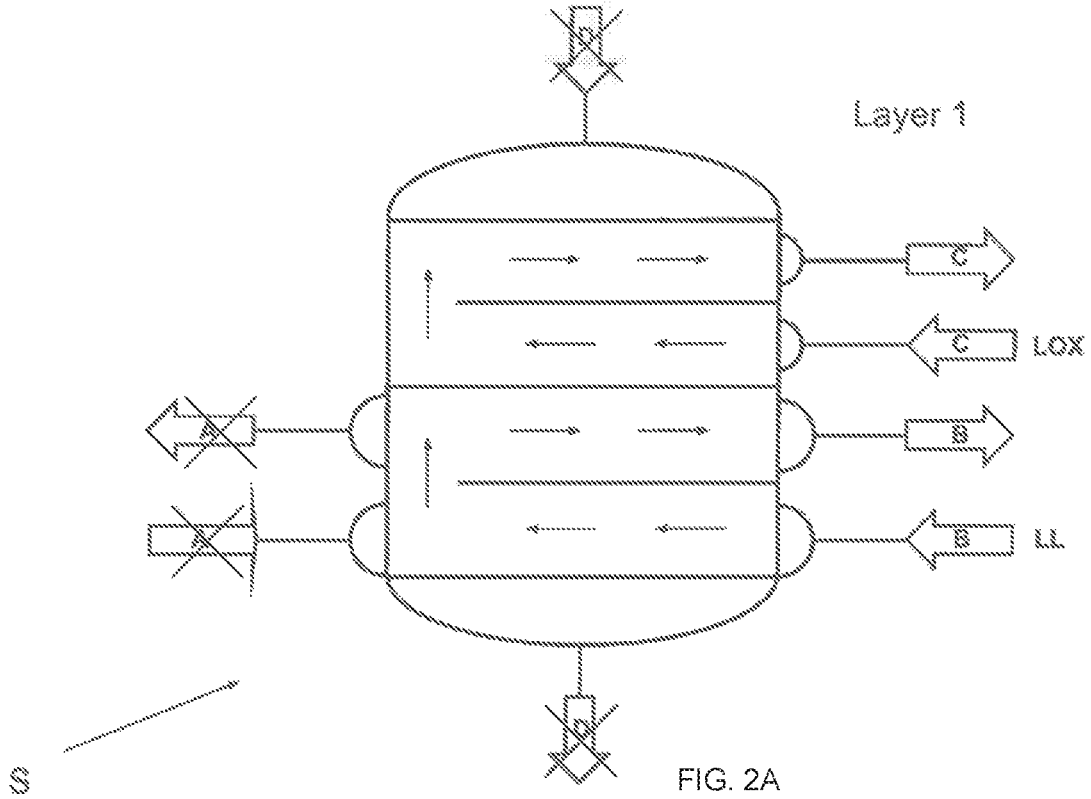
Figure 2B:
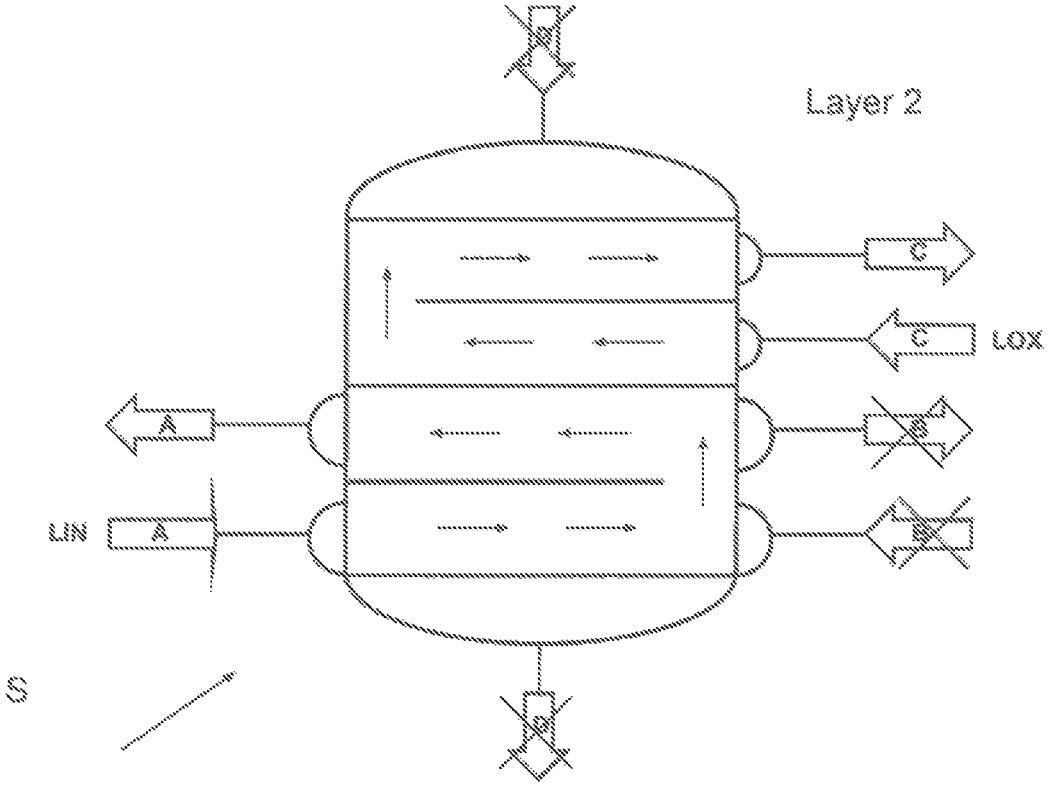

FIGS. 2A and 2B show cross-sections of the sections of a subcooler arrangement according to the invention devoted to cooling the liquid streams. Each of the figures shows the arrangements for the layers devoted to cooling, each being used for two cooling streams, each layer for a stream or stream to be cooled being separated from the next layer for a stream or streams to be cooled by a layer for a stream to be warmed.

The stream C in this case is cooled in two different layers, this being an optional feature.

In this way heat is transferred from one layer to another. The stream D enters the top of the subcooler (crossed out arrow D) through an inlet, flows straight down through the subcooler and emerges in a warmed state from the warm end of the subcooler via an exit. Stream D is the cold stream, waste nitrogen, to which heat is transferred and comes from the low pressure column of an air separation unit. Streams A and B are liquid nitrogen and lean liquid from the higher pressure column, and stream C is liquid oxygen from the bottom of a low pressure column.

In FIG. 2A, liquid oxygen C enters the subcooling exchanger at the colder half of the subcooler and exits the exchanger at the cold end. Here it is the liquid oxygen C which is cooled exclusively in the coldest part of the subcooler. The liquid oxygen flows at substantially at right angles to the gaseous nitrogen flows and no liquid inlet is closer to the cold end of the subcooler and no liquid outlet is closer to the cold end of the subcooler.

The liquid oxygen stream is cooled to a temperature at most 15° C., preferably at most 10° C., above the temperature at which the at least one nitrogen rich stream enters the nitrogen-rich stream inlet Lean liquid LL from the top of the higher pressure column is sent to the warm end of the subcooler in the same layer as liquid C and is removed in a cooled state from the middle of the subcooler.

In FIG. 3A, liquid oxygen C enters the subcooling exchanger at the colder half of the subcooler and exits the exchanger at the cold end. Here it is the liquid oxygen C which is cooled exclusively in the coldest part of the subcooler. The liquid oxygen flows at substantially at right angles to the gaseous nitrogen flows and no liquid inlet is closer to the cold end of the subcooler and no liquid outlet is closer to the cold end of the subcooler.

Liquid nitrogen LIN from the top of the higher pressure column is sent to the warm end of the subcooler in the same layer as liquid C and is removed in a cooled state from the middle of the subcooler.

The LOX will not necessarily be colder than in the prior art process, but may be so if the first section of the exchanger performs better than expected. As such, a partial bypass of LOX is installed (not shown) in order to control the temperature with this configuration. The LIN and LL will be warmer than in the prior art, as the WN and GAN have been warmed by the LOX. However the impact the oxygen recovery is minimal. Either the LIN and LL temperatures are only slightly changed or the LR and AL temperatures may be colder than hi the prior art, which has a compensating effect, depending on the ratio of the different warm and cold streams in the exchanger.

FIG. 3 shows a subcooler according the invention with two warming gases and four cooling liquids.

The subcooler comprises three regions 1,2,3, the region 1 operating below a temperature T1, the region 3 operating at a temperature T2, greater than T1 and region 2 operating between T1 and T2.

The warming gases are waste nitrogen WN and low pressure gaseous nitrogen LPGAN, both from the lower pressure column of the air separation unit.

The cooling streams are liquid oxygen LOX from the lower pressure column, liquid nitrogen LIN from the top of the higher pressure column, lean liquid LL from the top of the higher pressure column, containing more oxygen than liquid LIN and liquefied air AL taken from the higher pressure column, a conduit or a turbine outlet.

Here once again it is the liquid oxygen which is cooled exclusively in the coldest part 1 of the subcooler. The liquid oxygen flows at substantially at right angles to the gaseous nitrogen flows and no liquid inlet is closer to the cold end of the subcooler and no liquid outlet is closer to the cold end of the subcooler. The liquid oxygen stream is cooled to a temperature at most 15° C., preferably at most 10° C., above the temperature at which the at least one nitrogen rich stream enters the nitrogen-rich stream inlet Liquefied air AL is sent exclusively to the warm end of the subcooler and removed exclusively from a section 3 operating at the warmest temperatures. Rich liquid LR taken from the higher pressure column sump is sent exclusively to the warm end of the subcooler and removed exclusively from a section 3 operating at the warmest temperatures.

Lean liquid LL is sent to central region 2 of the subcooler and removed from that region operating between temperatures T1 and T2. Liquid LIN taken from the higher pressure column sump is sent exclusively to the central region 2 of the subcooler and removed exclusively from that region operating between temperatures T1 and T2.

The invention claimed is:

1. A cryogenic air separation unit comprising: a column system comprised of a higher-pressure column and a lower-pressure column; a plate fin heat exchanger assembly, the plate fin heat exchanger assembly comprising: a heat exchanger having at least two cryogenic liquid inlets at least two cryogenic liquid outlets, at least one nitrogen-rich stream inlet at a first end of the heat exchanger, and at least one nitrogen-rich stream outlet at a second end of the heat exchanger, the heat exchanger configured to receive a flow of at least one nitrogen-rich stream from the air separation unit at the at least one nitrogen-rich stream inlet and separate flows of at least two cryogenic liquids at the at least two cryogenic liquid inlets; the heat exchanger configured to receive a first flow of at least one cryogenic liquid of the air separation unit and further configured to channel the first flow of the at least one cryogenic liquid in a cross flow orientation from a first of the cryogenic liquid inlets to a first of the cryogenic liquid outlets; the heat exchanger configured to receive a second flow of the at least one cryogenic liquid of the air separation unit and for channeling the second flow of the at least one cryogenic liquid from a second of the cryogenic liquid inlets to a second of the cryogenic liquid outlets; and the heat exchanger configured to receive a portion of the flow of the at least one nitrogen-rich stream and for channeling a portion of the flow of the at least one nitrogen-rich stream in a first direction within a first heat exchange segment from the at least one nitrogen-rich stream inlet to the at least one nitrogen-rich stream outlet to sub-cool both the first flow of the at least one cryogenic liquid and the second flow of the at least one cryogenic liquid, wherein the first direction is orthogonal to the first flow of the at least one cryogenic liquid and wherein the inlet of the first of the cryogenic liquids is closer to the first end of the heat exchanger than the outlet of the second of the cryogenic liquids, wherein the plate fin heat exchanger assembly is connected to the lower-pressure column so that the first flow of the at least one cryogenic liquid comprises a flow of liquid oxygen from the lower-pressure column, wherein the plate fin heat exchanger assembly is connected to the higher-pressure column so that the second flow of the at least one cryogenic liquid comprises a flow of bottom liquid from the higher-pressure column or a flow of nitrogen enriched liquid from the higher-pressure column or a flow of liquefied air or a flow of liquefied nitrogen, wherein the outlet and inlet of the first of the cryogenic liquids are closer to the first end of the heat exchanger than any other cryogenic liquid inlet and any other cryogenic liquid outlet of the heat exchanger.

2. The cryogenic air separation unit of claim 1, wherein the first direction is orthogonal to the second flow of the at least one cryogenic liquid.

3. The cryogenic air separation unit of claim 1, comprising a third cryogenic liquid inlet, a third cryogenic outlet, the heat exchanger configured to receive a third flow of the at least one cryogenic liquid of the air separation unit and for channeling the third flow of the at least one cryogenic liquid from a third of the cryogenic liquid inlets to a third of the cryogenic liquid outlets, wherein the inlet of the first of the cryogenic liquids is closer to the first end of the heat exchanger than the outlet of the third of the cryogenic liquids.

4. The cryogenic air separation unit of claim 1, wherein the first flow of the at least one cryogenic liquid comprises a flow of liquid oxygen from the lower-pressure column.

5. The cryogenic air separation unit of claim 1, wherein the second or third cryogenic liquid inlet is closer to the second end than any other ones of the cryogenic liquid inlet or outlet.

6. The cryogenic air separation unit of claim 1, wherein the flow of the at least one nitrogen-rich stream in the first direction is a flow in an upward or downward orientation.

7. The cryogenic air separation unit of claim 1, wherein the cryogenic liquid inlets are disposed vertically below the corresponding cryogenic liquid outlets such that the overall flow of the cryogenic liquids is in an upward flow orientation if the at least nitrogen-rich stream is a flow in a downward orientation.

8. The cryogenic air separation unit of claim 1, wherein the cryogenic liquid inlets are above the corresponding liquid outlets if the nitrogen-rich stream flow is in an upward direction.

9. A process for cooling and warming streams from the cryogenic air separation unit in the plate fin heat exchanger assembly, the process comprising the steps of: providing the air separation unit of claim 1; warming the at least one nitrogen-rich stream, selected from the group consisting of a waste nitrogen stream, a product nitrogen stream, a third nitrogen-rich return stream from the column system, and combinations thereof, by passing through the heat exchanger assembly from the nitrogen enriched fluid inlet to the nitrogen enriched fluid outlet; cooling a liquid oxygen stream by passing from the first cryogenic liquid inlet to the first cryogenic liquid outlet; and cooling another cryogenic stream by passing from the second cryogenic liquid inlet to the second cryogenic liquid outlet, such that the liquid oxygen stream is cooled exclusively in the region of the heat exchanger proximate to the first end, wherein the other cryogenic stream is cooled exclusively outside the region of the heat exchanger proximate to the first end.

10. The process according to claim 9, wherein the liquid oxygen stream is cooled to a temperature at most 15° C. above the temperature at which the at least one nitrogen rich stream enters the nitrogen-rich stream inlet.

11. The process according to claim 10, wherein the liquid oxygen stream is cooled to a temperature at most 10° C. above the temperature at which the at least one nitrogen rich stream enters the nitrogen-rich stream inlet.

* * * * *